US012378036B1

(12) United States Patent
Desravines

(10) Patent No.: US 12,378,036 B1
(45) Date of Patent: Aug. 5, 2025

(54) COMBINATION DRINK CONTAINER AND SANITIZER DISPENSER

(71) Applicant: Michael Desravines, Lake City, FL (US)

(72) Inventor: Michael Desravines, Lake City, FL (US)

( * ) Notice: Subject to any disclaimer, the term of this patent is extended or adjusted under 35 U.S.C. 154(b) by 270 days.

(21) Appl. No.: 18/103,577

(22) Filed: Jan. 31, 2023

(51) Int. Cl.

| | |
|---|---|
| ***B65D 25/04*** | (2006.01) |
| ***A47K 5/12*** | (2006.01) |
| ***B65D 41/04*** | (2006.01) |
| ***B65D 81/38*** | (2006.01) |

(52) U.S. Cl.
CPC ..... *B65D 25/04* (2013.01); *A47K 5/1201* (2013.01); *B65D 41/04* (2013.01); *B65D 81/3841* (2013.01)

(58) Field of Classification Search
CPC .... B65D 25/04; B65D 41/04; B65D 81/3841; A47K 5/1201; A47K 5/122; A45C 11/00; A61L 2/18; A47J 41/00; A47G 2019/122; B05B 11/1036
USPC .... 222/131, 133, 139, 632, 130, 135, 145.3; 221/96
See application file for complete search history.

(56) References Cited

U.S. PATENT DOCUMENTS

| | | | | |
|---|---|---|---|---|
| 6,010,034 | A | 1/2000 | Walthers | |
| 6,138,870 | A * | 10/2000 | Lin | B05B 11/0038 40/406 |
| D451,029 | S | 11/2001 | Hoffmann | |
| 7,270,244 | B1 | 9/2007 | Liu | |
| 9,975,660 | B2 | 5/2018 | Cartledge | |
| 10,349,779 | B1 * | 7/2019 | Garcia | A47J 43/27 |
| 2006/0102581 | A1 * | 5/2006 | Yates | B65D 81/3216 215/6 |
| 2012/0152771 | A1 | 6/2012 | Garside | |
| 2013/0277326 | A1 | 10/2013 | Gold | |
| 2021/0393828 | A1 * | 12/2021 | Garside | A47K 5/1201 |
| 2023/0016269 | A1 * | 1/2023 | Romano | A47J 41/0072 |

FOREIGN PATENT DOCUMENTS

| | | |
|---|---|---|
| EP | 2653405 | 10/2013 |

* cited by examiner

*Primary Examiner* — Paul R Durand
*Assistant Examiner* — Michael C Patterson
(74) *Attorney, Agent, or Firm* — Kyle A. Fletcher, Esq.

(57) ABSTRACT

The combination drink container and sanitizer dispenser may include a bottle and a top cap. The bottle may have a double wall that includes an outer wall and an inner wall. A beverage may be stored in a beverage cavity formed by the inner wall. As non-limiting examples, the beverage may be water or a sports drink. A sanitizing product may be stored within a sanitizer cavity formed by a gap between the inner wall and the outer wall. As a non-limiting example, the sanitizing product may be a hand sanitizer gel. The beverage may be dispensed from the bottle through an open top of the bottle. The sanitizing product may be dispensed through a pinhole disposed on the side of the outer wall when a dispense button is pressed.

19 Claims, 5 Drawing Sheets

COMBINATION DRINK CONTAINER AND SANITIZER DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of beverage containers and dispensing devices, more specifically, a combination drink container and sanitizer dispenser.

SUMMARY OF INVENTION

The combination drink container and sanitizer dispenser may comprise a bottle and a top cap. The bottle may have a double wall comprising an outer wall and an inner wall. A beverage may be stored in a beverage cavity formed by the inner wall. As non-limiting examples, the beverage may be water or a sports drink. A sanitizing product may be stored within a sanitizer cavity formed by a gap between the inner wall and the outer wall. As a non-limiting example, the sanitizing product may be a hand sanitizer gel. The beverage may be dispensed from the bottle through an open top of the bottle, either by pouring the beverage or by drinking the beverage directly from the bottle. The sanitizing product may be dispensed through a pinhole disposed on the side of the outer wall when a dispense button is pressed.

An object of the invention is to provide a bottle for transporting and dispensing a beverage.

Another object of the invention is to provide a double wall for the bottle such that a gap between an outer wall and an inner wall forms a sanitizer cavity for holding a sanitizing product.

A further object of the invention is to provide a dispense button to force the sanitizing product out through a pinhole located on the outer wall of the bottle.

Yet another object of the invention is to provide a cap to seal the bottle.

These together with additional objects, features and advantages of the combination drink container and sanitizer dispenser will be readily apparent to those of ordinary skill in the art upon reading the following detailed description of the presently preferred, but nonetheless illustrative, embodiments when taken in conjunction with the accompanying drawings.

In this respect, before explaining the current embodiments of the combination drink container and sanitizer dispenser in detail, it is to be understood that the combination drink container and sanitizer dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the combination drink container and sanitizer dispenser.

It is therefore important that the claims be regarded as including such equivalent construction insofar as they do not depart from the spirit and scope of the combination drink container and sanitizer dispenser. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
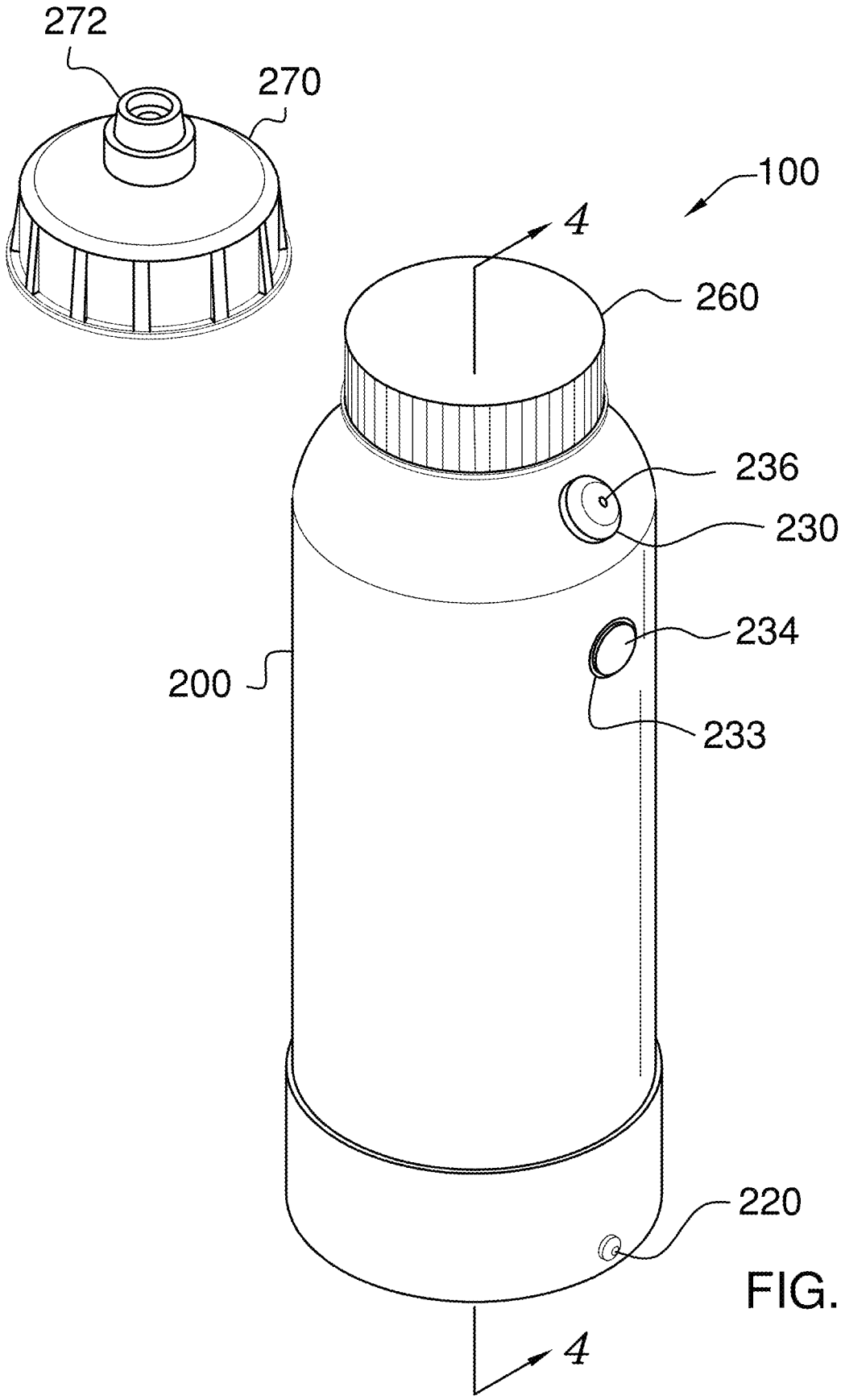
FIG. 1 is an isometric view of an embodiment of the disclosure.
Figure 2:
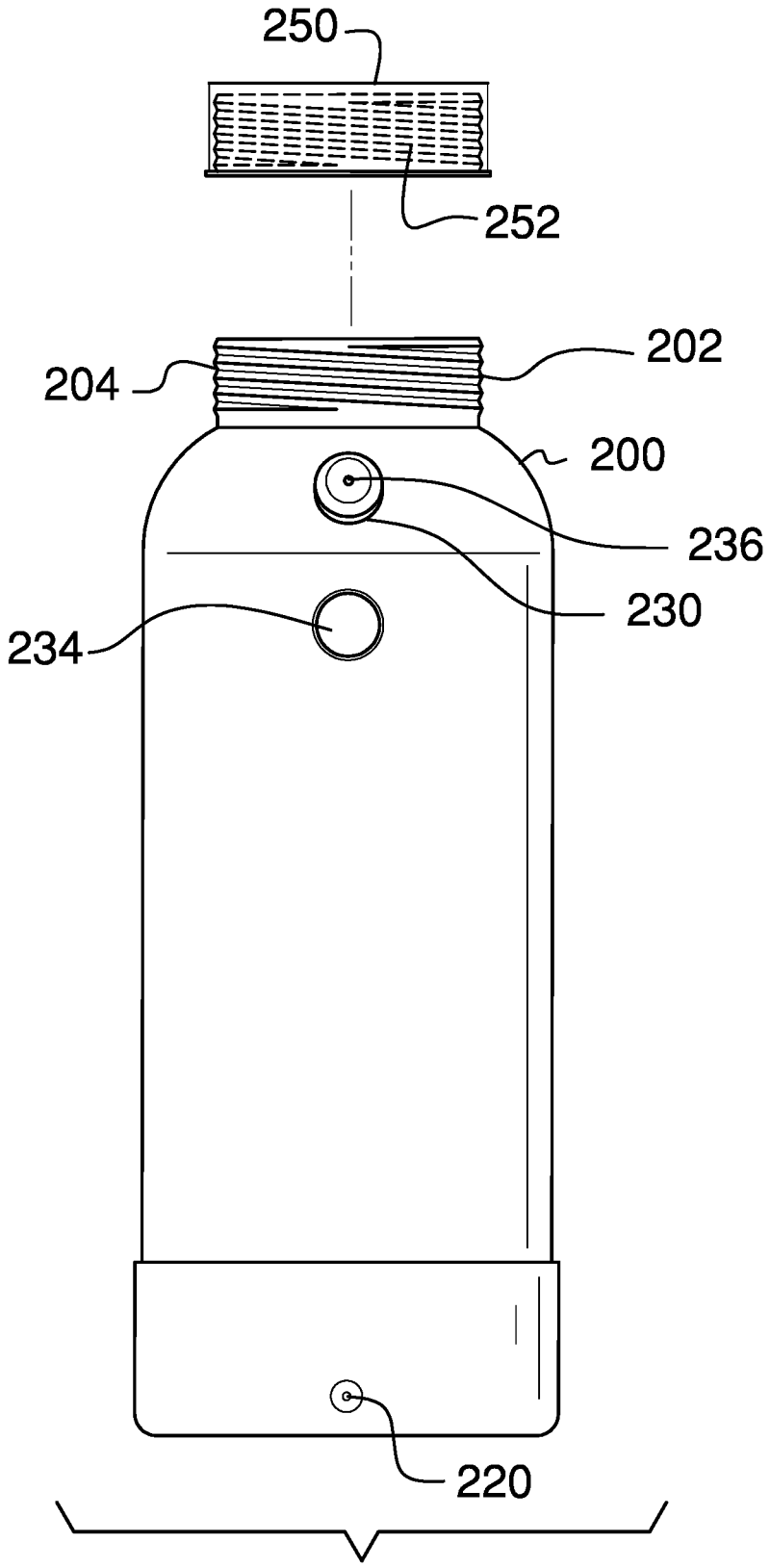
FIG. 2 is a front view of an embodiment of the disclosure.
Figure 3:
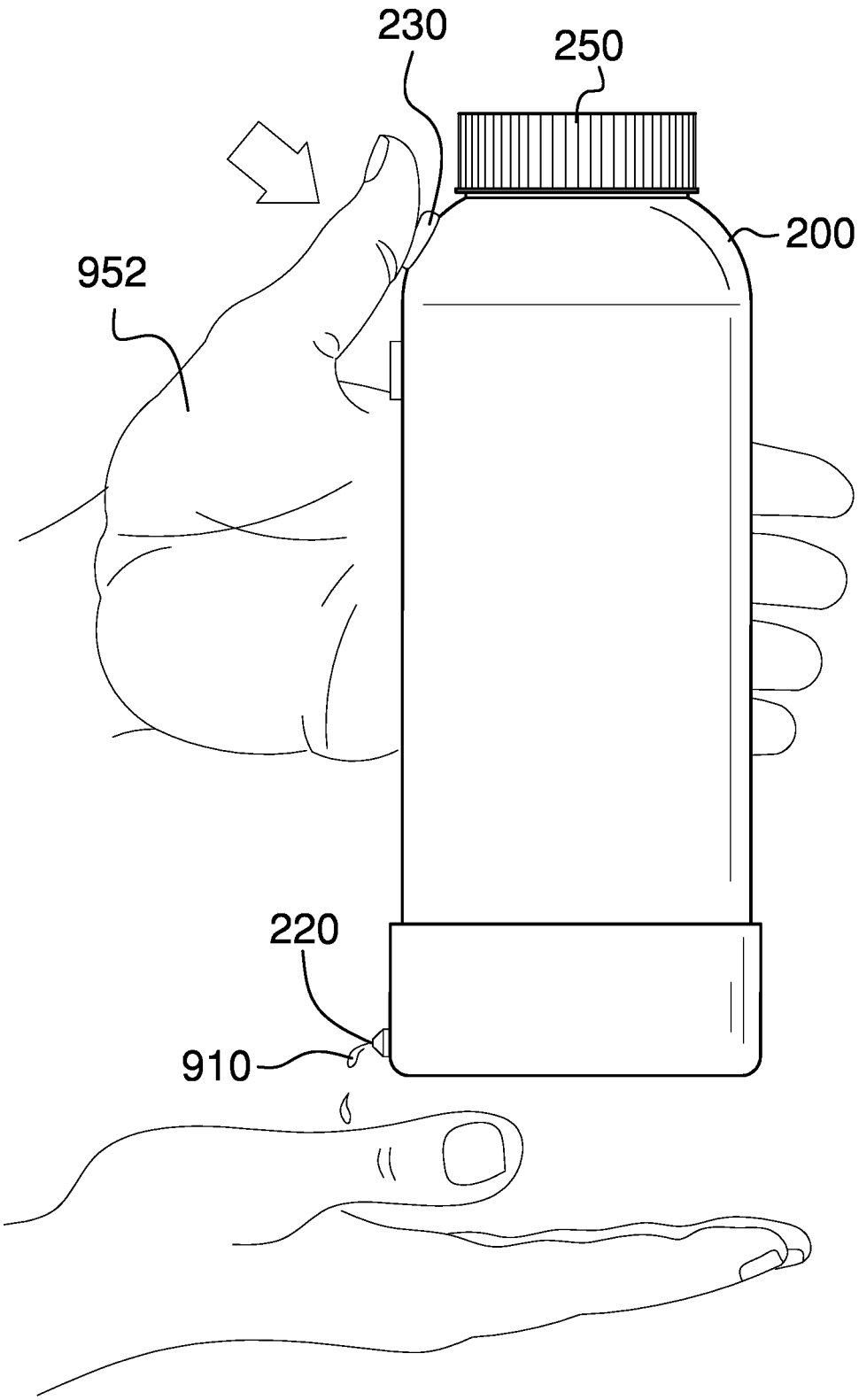
FIG. 3 is an in-use view of an embodiment of the disclosure.
Figure 4:
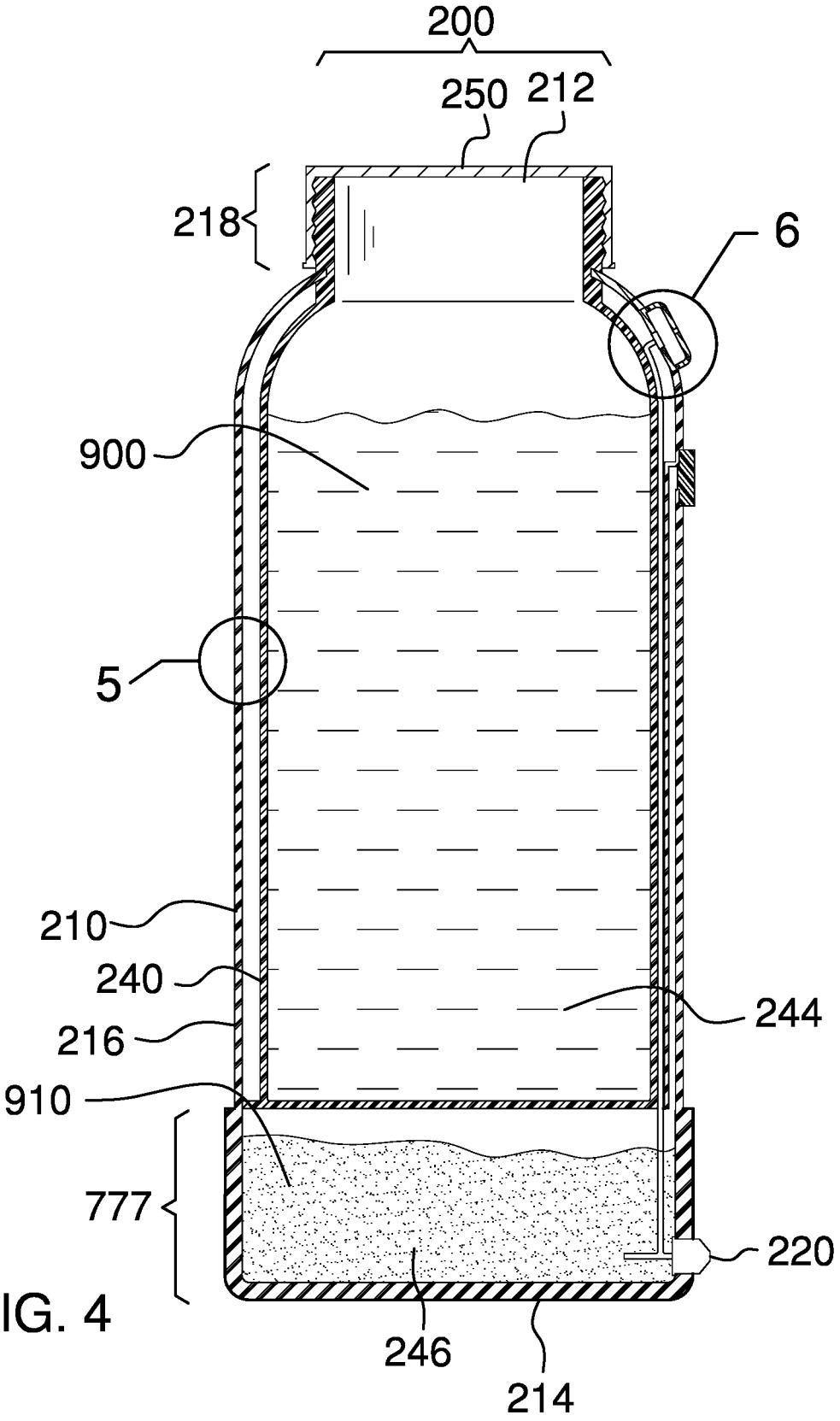
FIG. 4 is a cross-sectional view of an embodiment of the disclosure across 4-4 as shown in FIG. 1.
Figure 5:
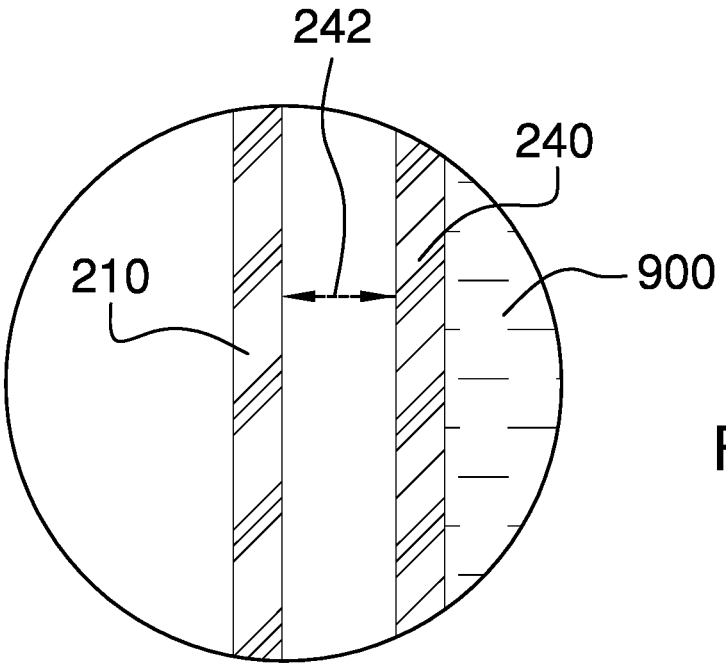
FIG. 5 is a detail view of an embodiment of the disclosure illustrating the area marked 5 in FIG. 4.
Figure 6:
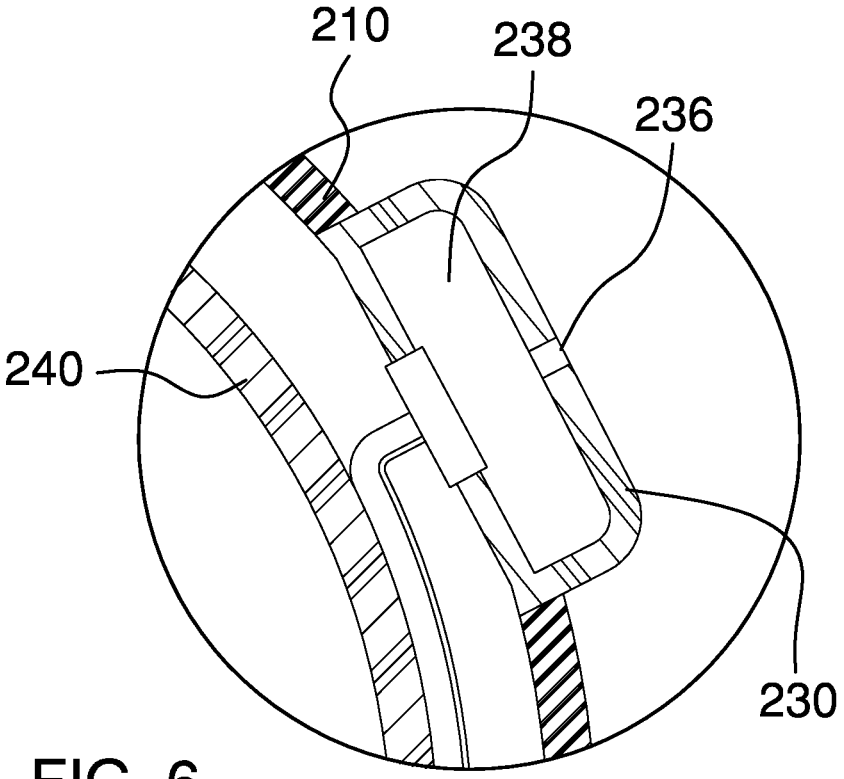
FIG. 6 is a detail view of an embodiment of the disclosure illustrating the area marked 6 in FIG. 4.

Detailed reference will now be made to a first potential embodiment of the disclosure, which is illustrated in FIGS. 1 through 6.

The combination drink container and sanitizer dispenser 100 (hereinafter invention) comprises a bottle 200 and a top cap 250. The bottle 200 may have a double wall comprising an outer wall 210 and an inner wall 240. A beverage 900 may be stored in a beverage cavity 244 formed by the inner wall 240. As non-limiting examples, the beverage 900 may be water or a sports drink. A sanitizing product 910 may be stored within a sanitizer cavity 246 formed by a gap 242 between the inner wall 240 and the outer wall 210 as well as a lower portion 777 of the bottle 200. It shall be noted that the lower portion 777 of the bottle 200 is separated from the beverage cavity 244.

As a non-limiting example, the sanitizing product 910 may be a hand sanitizer gel. The beverage 900 may be dispensed from the bottle 200 through an open top 212 of the bottle 200, either by pouring the beverage 900 or by drinking the beverage 900 directly from the bottle 200. The sanitizing product 910 may be dispensed through a pinhole 220 disposed on the side of the outer wall 210 when a dispense button 230 is pressed.

The bottle 200 may be a container for storing the beverage 900. The bottle 200 may comprise the outer wall 210 and the inner wall 240. The outer wall 210 may be separated from the inner wall 240 by the gap 242 having uniform spacing between the outer wall 210 and the inner wall 240. The outer wall 210 may comprise a flat bottom 214 such that the bottle 200 may stand upright. The outer wall 210 may comprise a side wall 216 which may be coupled to the flat bottom 214 at the bottom of the side wall 216 and which may constrict to form a neck 218 at the top of the bottle 200. The inner wall 240 may follow the contour of the outer wall 210 to maintain the gap 242. The outer wall 210 and the inner wall 240 may join at the neck 218 of the bottle 200

The outer wall 210 may comprise the pinhole 220 such that the sanitizing product 910 may be dispensed through the outer wall 210 when a dispense button 230 is pressed. The sanitizing product 910 may be contained within the sanitizer cavity 246 located between the outer wall 210 and the inner wall 240.

The dispense button 230 may be a semi-rigid button located on the outer wall 210. The dispense button 230 may be operable to pressurize the sanitizer cavity 246 when the dispense button 230 is pressed. Increased pressure within the sanitizer cavity 246 may force the sanitizing product 910 out of the sanitizer cavity 246 via the pinhole 220.

The dispense button 230 may comprise a valve 238 to allow the pressure within the sanitizer cavity 246 to equalize after dispensing the sanitizing product 910 by drawing air in through a pressure relief aperture 236. The pressure relief aperture 236 may be adapted to be covered by user's thumb while pressing the dispense button 230 and may therefore cause the pressure within the sanitizer cavity 246 to increase as the dispense button 230 is pressed, forcing the sanitizing product 910 out through the pinhole 220. The pressure relief aperture 236 may be adapted to be uncovered when a user releases the dispense button 230 and may allow air to enter the sanitizer cavity 246 to equalize the pressure, instead of sucking air in through the pinhole 220 as the dispense button 230 is released.

A refill aperture 233 may pass through the outer wall 210 adjacent to the neck 218 near the top of the bottle 200. The sanitizing product 910 may be added to the sanitizer cavity 246 by pouring the sanitizing product 910 into the sanitizer cavity 246 through the refill aperture 233. The refill aperture 233 may be sealed with a refill cap 234 after refilling.

The neck 218 of the bottle 200 may comprise a threaded top 202. The threaded top 202 may comprise external threading 204 such that the top cap 250 may removably couple to the bottle 200 at the neck 218.

The gap 242 between the outer wall 210 and the inner wall 240 may provide thermal insulation for the beverage 900 container within the beverage cavity 244. The thermal insulation may be provided by air within the gap 242, by the sanitizing product 910 within the gap 242, or by any combination thereof.

The top cap 250 may couple to the neck 218 of the bottle 200 and may seal the open top 212 of the bottle 200 to prevent the beverage 900 from spilling out. The bottom of the top cap 250 may comprise internal threading 252 such that the top cap 250 may removably couple to the bottle 200 at the neck 218. The internal threading 252 of the top cap 250 may be complementary to the external threading 204 of the neck 218 such that the top cap 250 and the bottle 200 may form a watertight seal when the top cap 250 is secured to the neck 218 of the bottle 200.

In some embodiments, the top cap 250 may be a closed cap 260. The closed cap 260 may removably couple to the bottle 200 and may require removal to access the beverage 900.

In some embodiments, the top cap 250 may be a sports cap 270. The sports cap 270 may removably couple to the bottle 200 and may comprise a mouthpiece 272 that may be opened to access the beverage 900. As a non-limiting example, the mouthpiece 272 of the sports cap 270 may be adapted to slide up to open the bottle 200 and allow the user to drink from the bottle 200 and may slide down to reseal the bottle 200 and prevent spilling.

In use, after filling the beverage cavity 244 with the beverage 900 and the sanitizer cavity 246 with the sanitizing product 910, the user may carry the bottle 200 with them as they walk, hike, bike, or perform other activities. When thirsty, the user may remove the top cap 250 and drink the beverage 900 from the open top 212 of the bottle 200 or, in some embodiments, drink the beverage 900 directly through the sports cap 270 without removing the top cap 250. To sanitize the user's hand 952, the user may hold the bottle 200 and press the dispense button 230 to force the sanitizing product 910 to be dispensed through the pinhole 220 in the side wall 216 of the bottle 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "beverage" may be a liquid that is intended for consumption by a person.

As used in this disclosure, a "bottle" may be a container used for the storage of fluids. Access to the interior of a bottle is gained through the neck of the bottle. The neck may be an elongated tube that forms an aperture through which fluids can be introduced and removed from the bottle.

As used in this disclosure, a "cavity" may be an empty space or negative space that is formed within an object.

As used herein, "complement" or "complementary" may refer to a compatibility between threaded parts such that the gender, handedness, form, angle, pitch, diameter, and thread depth of both threads are compatible for the parts to mate by screwing the threads together.

As used herein, the words "couple", "couples", "coupled" or "coupling", may refer to connecting, either directly or indirectly, and does not necessarily imply a mechanical connection.

As used herein, "filling", or "refilling", refers to the act of placing a first item into a second item whether the quantity of the first item fills the second item or not. As non-limiting examples, the first item may be a liquid, such as water, oil, or gasoline, or a granulated solid, such as sand or coffee beans. As non-limiting examples, the second item may be a bin, a bottle, a tank, or another type of container.

As used herein, "mouthpiece" may refer to an element that is a designed to have lips placed against it.

As used herein, "resilient" or "semi-rigid" may refer to an object or material which may deform when a force is applied to it and which will return to its original shape when the deforming force is removed.

As used herein, "thermally insulated/thermally insulating" may refer to a property of a material that reduces the transfer of heat through the material. "Thermal insulation" may refer to a material having the property of being thermally insulating.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

As used herein, the word "watertight" may refer to a barrier that is impermeable to water.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A combination drink container and sanitizer dispenser comprising:

a bottle and a top cap;

wherein the bottle has a double wall comprising an outer wall and an inner wall;

wherein a beverage is stored in a beverage cavity formed by the inner wall;

wherein a sanitizing product is stored within a sanitizer cavity formed by a gap between the inner wall and the outer wall and a lower portion of the bottle;

wherein the beverage is dispensed from the bottle through an open top of the bottle;

wherein the sanitizing product is dispensed through a pinhole disposed on a side of the outer wall when a dispense button is pressed.

2. The combination drink container and sanitizer dispenser according to claim 1 wherein the bottle is a container for storing the beverage;

wherein the outer wall is separated from the inner wall by the gap.

3. The combination drink container and sanitizer dispenser according to claim 2 wherein the outer wall comprises a flat bottom such that the bottle stands upright;

wherein the outer wall comprises a side wall which is coupled to the flat bottom at the bottom of the side wall and which constricts to form a neck at the top of the bottle.

4. The combination drink container and sanitizer dispenser according to claim 3 wherein the outer wall and the inner wall join at the neck of the bottle.

5. The combination drink container and sanitizer dispenser according to claim 4 wherein the sanitizing product is contained within the sanitizer cavity located in the gap.

6. The combination drink container and sanitizer dispenser according to claim 5 wherein the dispense button is a semi-rigid button located on the outer wall.

7. The combination drink container and sanitizer dispenser according to claim 6 wherein the dispense button is operable to pressurize the sanitizer cavity when the dispense button is pressed;

wherein increased pressure within the sanitizer cavity forces the sanitizing product out of the sanitizer cavity via the pinhole.

8. The combination drink container and sanitizer dispenser according to claim 7 wherein the dispense button comprises a pressure relief aperture;

wherein the pressure relief aperture is adapted to be covered by user's thumb while pressing the dispense button and causes the pressure within the sanitizer cavity to increase as the dispense button is pressed, forcing the sanitizing product out through the pinhole;

wherein the pressure relief aperture is adapted to be uncovered when a user releases the dispense button and allows air to enter the sanitizer cavity to equalize the pressure.

9. The combination drink container and sanitizer dispenser according to claim 8 wherein a refill aperture passes through the outer wall adjacent to the neck;

wherein the sanitizing product is added to the sanitizer cavity by pouring the sanitizing product into the sanitizer cavity through the refill aperture.

10. The combination drink container and sanitizer dispenser according to claim 9 wherein the refill aperture is sealed with a refill cap after refilling.

11. The combination drink container and sanitizer dispenser according to claim 10 wherein the neck of the bottle comprises a threaded top;

wherein the threaded top comprises external threading such that the top cap removably couples to the bottle at the neck.

12. The combination drink container and sanitizer dispenser according to claim 11 wherein the gap between the outer wall and the inner wall provides thermal insulation for the beverage container within the beverage cavity.

13. The combination drink container and sanitizer dispenser according to claim 12 wherein the thermal insulation is provided by said air within the gap, by the sanitizing product within the gap, or by any combination thereof.

14. The combination drink container and sanitizer dispenser according to claim 11 wherein the top cap couples to the neck of the bottle and seals the open top of the bottle to prevent the beverage from spilling out.

15. The combination drink container and sanitizer dispenser according to claim 14 wherein the bottom of the top cap comprises internal threading such that the top cap removably couples to the bottle at the neck.

16. The combination drink container and sanitizer dispenser according to claim 15 wherein the internal threading of the top cap is complementary to the external threading of the neck such that the top cap and the bottle form a watertight seal when the top cap is secured to the neck of the bottle.

17. The combination drink container and sanitizer dispenser according to claim 16 wherein the top cap is a closed cap;

wherein the closed cap removably couples to the bottle and requires removal to access the beverage.

18. The combination drink container and sanitizer dispenser according to claim 16 wherein the top cap is a sports cap;

wherein the sports cap removably couples to the bottle and comprises a mouthpiece that is opened to access the beverage.

19. The combination drink container and sanitizer dispenser according to claim 18 wherein the mouthpiece of the sports cap is adapted to slide up to open the bottle and allow the user to drink from the bottle and to slide down to reseal the bottle and prevent spilling.

* * * * *